United States Patent [19]

Larson

[11] 4,317,013

[45] Feb. 23, 1982

[54] MEMBRANE SWITCH WITH UNIVERSAL SPACER MEANS

[75] Inventor: Willis A. Larson, Crystal Lake, Ill.

[73] Assignee: Oak Industries, Inc., Rancho Bernardo, Calif.

[21] Appl. No.: 138,656

[22] Filed: Apr. 9, 1980

[51] Int. Cl.[3] ..... H01H 9/00

[52] U.S. Cl. ..... 200/5 A; 29/622; 200/159 B

[58] Field of Search ..... 200/5 A, 159 B; 29/622

[56] References Cited

U.S. PATENT DOCUMENTS

| | | | |
|---|---|---|---|
| 3,699,294 | 10/1972 | Sudduth | 200/159 B |
| 4,017,697 | 4/1977 | Larson | 200/5 A |
| 4,066,854 | 1/1978 | Zenk et al. | 200/5 A |
| 4,145,584 | 3/1979 | Otterlei | 200/5 A |

*Primary Examiner*—J. V. Truhe

*Assistant Examiner*—Morris Ginsburg

*Attorney, Agent, or Firm*—Kinzer, Plyer, Dorn and McEachran

[57] ABSTRACT

A method and apparatus for forming a membrane switch of the type having a flexible membrane, a substrate, first and second conductors formed on the membrane and substrate and spacing means disposed between the first and second conductors. The spacing means is applied to either the membrane or substrate in a uniform pattern of individual spacer areas. The spacer areas are applied in liquid form which is cured or allowed to dry. The pattern of spacer areas can be applied without regard to the location of the conductors. The size, spacing and thickness of the spacer areas allow contact between aligned first and second conductors when the exterior of the membrane is subjected to pressure. Thus the same pattern of spacer areas can be used with any arrangement of conductors.

15 Claims, 11 Drawing Figures fig.6.
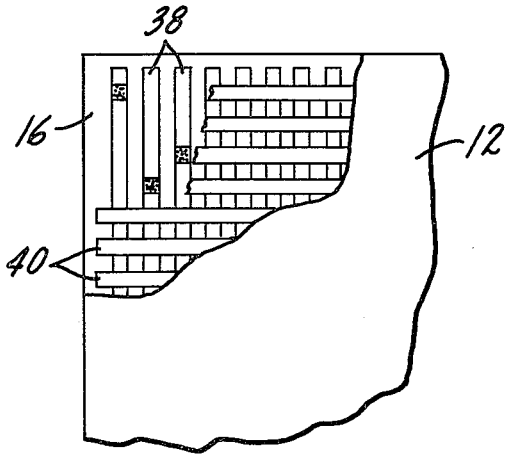
fig.7.
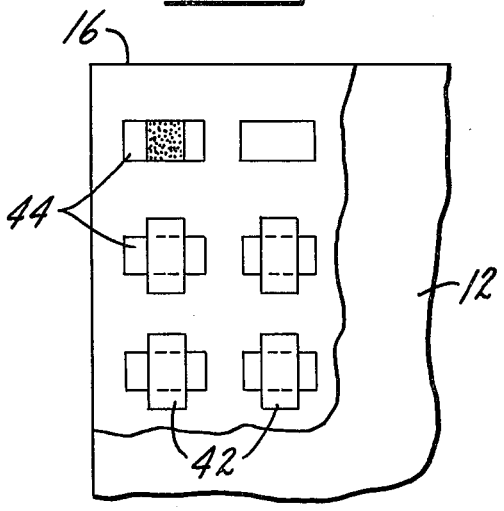
fig.8.
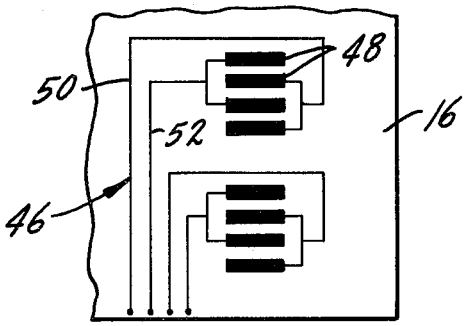
fig.9.
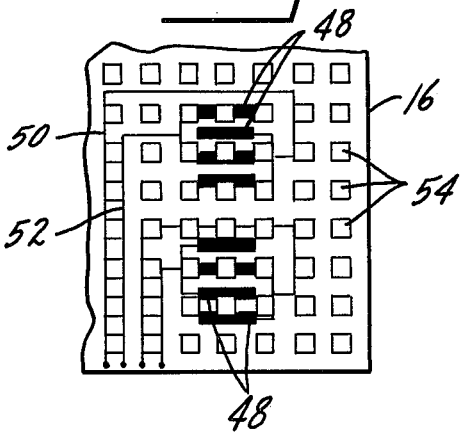
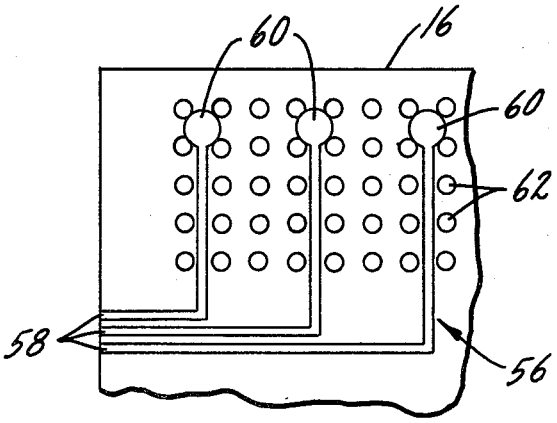
fig.10.
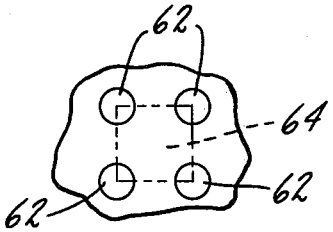
fig.11.

MEMBRANE SWITCH WITH UNIVERSAL SPACER MEANS

SUMMARY OF THE INVENTION

The present invention relates to membrane switches and in particular to spacing means for such switches and more specifically to a universal spacing means which can be used with any arrangement of conductors on the switch surfaces.

One purpose is a spacing means of the type described in which a uniform pattern of individual, non-conductive spacer areas is applied, without regard to the location of conductors, to either the membrane or substrate or both.

Another purpose is a spacing means of the type described which may include an adhesive material applied to some or all of the spacer areas.

Another purpose is a membrane switch of the type described which may be completely sealed but has a spacer construction which prevents creation of pressure imbalance due to barometric or temperature changes or during actuation of the switch.

Another purpose is a membrane switch of the type described which eliminates the need for registering the location of a spacer with respect to the conductors.

Another purpose is a spacing means of the type described which is formed using minimal amounts of relatively inexpensive material.

Other purposes will appear in the ensuing specification, drawings and claims.

BRIEF DESCRIPTION OF THE DRAWINGS

The invention is illustrated diagrammatically in the following drawings wherein;

FIG. 6 is a top plan view of a switch with a portion of the membrane removed, illustrating another alternate spacing means.

FIG. 7 is a top plan view of a switch with a portion of the membrane removed, showing still another alternate spacing means.

FIG. 8 and FIG. 9 are top plan views of a portion of a substrate with a variant form of conductors applied thereto, FIG. 8 showing the switch before application of the spacer means and FIG. 9 showing the switch after the application of the spacer means.

FIG. 10 is a top plan view of a switch with the membrane removed, illustrating a further form of spacing means.

FIG. 11 is a top plan view of a portion of the spacing means of FIG. 10, showing a unit cell of a spacing means.

DESCRIPTION OF THE PREFERRED EMBODIMENT

Figure 1:
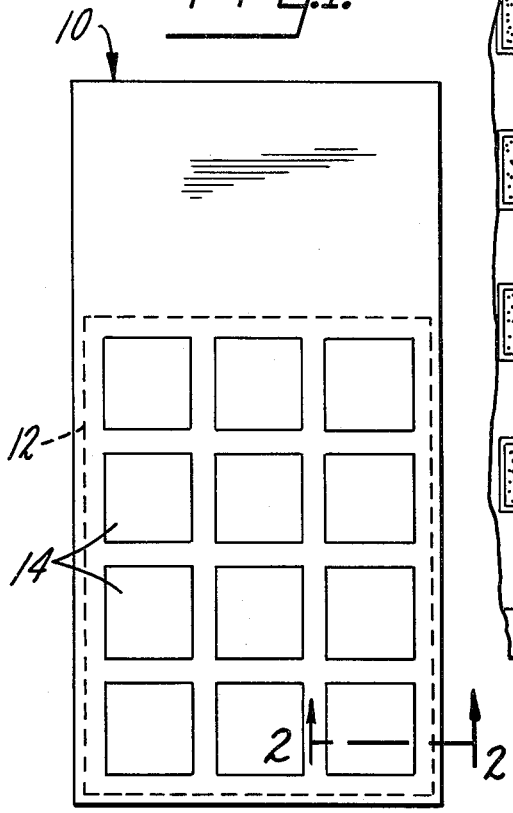
FIG. 1 is a top plan view of a hand-held device in which the switch of the prresent invention may be incorporated.

The present invention concerns membrane switches of the type generally shown in U.S. Pat. Nos. 3,988,551 and 4,017,697, as well as a number of similar patents relating to the same subject matter.

With the introduction of microprocessers and other sophisticated relatively inexpensive electronics, switching functions can now be reduced to the opening and closing of contacts permitting a simplified and more reliable switch construction. The membrane switch disclosed herein is specifically directed to this concept wherein there is only an opening and closure of a switch contact with more sophisticated switching functions being carried on by the auxiliary electronics.

More specifically, the present invention relates to the spacing means for use with such a switch. A typical membrane switch consists of several parts: a substrate, which may be rigid or flexible and has stationary conductors formed on its upper surface; a membrane which is flexible and has conductors applied to its under side; and a spacer which is disposed between the membrane and substrate in such a way that it holds the membrane above the substrate in a spaced relationship of several thousandths of an inch. The spacer has holes or openings through which the conductors on the flexible membranes may move in and out of contact with the conductors on the substrate. The membranes may also have graphics and/or nomenclature printed on one of its surfaces to provide switch designations and other color or design features.

When a user's finger, or some other actuating member, applies pressure on a flexible membrane it is forced through an opening in the spacer so that the movable conductor makes contact with the fixed conductor on the substrate, thus forming a switch closure. When the actuating member is removed, the resiliency of the flexible membrane causes it to return to the normal position, spaced from and above the conductor on the substrate.

In the early versions of membrane switches the spacer was a separate layer of polyester, such as Mylar, placed between the membrane and substrate. The spacer would have holes die cut in the polyester material to permit the contact between conductors when the switch was actuated. Die cutting a separate layer of plastic sheet material is a relatively expensive operation. Furthermore, the holes have to be cut in the proper location for each particular arrangement of conductors. That is, it is desirable to have a plurality of separate switches formed on a single membrane and substrate. This is done by applying the conductors in appropriate patterns of contact sites or pads and connecting leads. However, a diecut spacer must be "custom-made" so that the holes are in register with the contact pads of a particular conductor. Another disadvantage of the polyester spacer is that it compounds assembly difficulties because the spacer must be properly located on the substrate so that the die cut holes line up with the contact pads on the membrane and substrate. Also, the spacer is held in place by adhesive material which, together with the associated release liner, adds to the cost and difficulty in handling.

Other versions of membrane switches substitute a layer of sprayed or silk screened material for the polyester spacer. This has the advantage of eliminating die cutting operations but the spacer still has to be individually designed for each conductor pattern and the application of the spacer has to be carefully controlled so that the openings in the non-conductive spacer layer are in register with the contact pads. These spacers must also be relatively thick to support the membrane above the openings.

The spacer means of the present invention eliminates the need to design an individual spacer for every pattern of conductors. The spacer means of the present invention can be used with any conductor pattern. Furthermore it may be applied without regard to the location of the contact pads in a particular conductor pattern. The spacer means of the present invention is defined as being universal in that it has the intended size, spacing and thickness that can be applied to various forms of conductors without regard to where those conductors lie.

Looking now at FIG. 1, a typical device 10 is shown in which a membrane switch constructed in accordance with the present invention may be incorporated. While the device 10 is generally depicted as a hand-held device, such as a calculator or electronic game, it will be understood this is for illustrative purposes only and that the switch of the present invention could be incorporated wherever such switches are used. This would include all manner of data entry panels, controls and the like. The device as shown has a membrane 12 with indicia 14 formed on the exterior surface of the membrane. The indicia 14 are shown diagramatically as squares but naturally the indicia may include numbers or other information for the user. Some sort of protective covering could be placed over the indicia to prevent them from being worn away. Alternately, the indicia could be on the under side of a transparent membrane. A separate contact pad is located beneath each indicia so the illustrated device comprises twelve separate switches.

Figure 2:
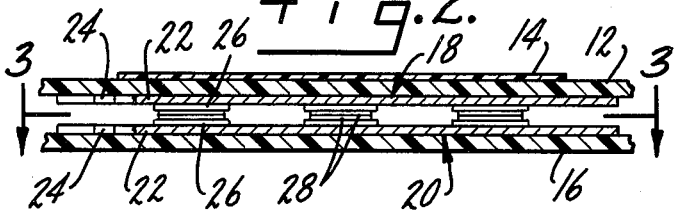
FIG. 2 is an enlarged section, taken along line 2—2 of FIG. 1.

A cross section of one of these switches is shown in FIG. 2. In addition to the membrane 12 the switch has a substrate 16. Both the membrane and substrate may be formed from polyester sheet material, on the order of 5 mils thick. Alternatively, the substrate could be a rigid surface, such as a printed circuit board. First conductors 18 are formed on the membrane 12. Second conductors 20 are formed on the substrate 16. The first and second conductors are shown as including a plurality of electrically conductive contact spots or pads 22 which are connected to auxiliary electronics by individual leads 24.

Figure 3:
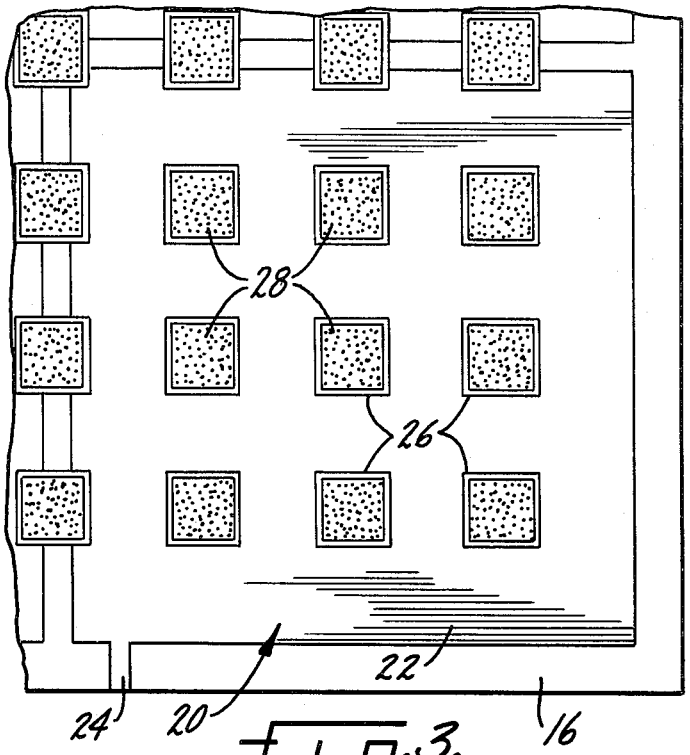
FIG. 3 is an enlarged section, taken along line 3—3 of FIG. 2.

As can be seen in FIG. 3, the conductors in this particular embodiment are shown as squares of conductive material. These squares may be formed from a carbon material, approximately 1 mil thick and on the order of a half inch square. Each square will also have a conductor lead 24 which may extend to an edge or tail of the switch for connection to the auxiliary electronics. It will be understood that the first and second conductors could have any form or configuration and the pattern of squares with leads shown is intended to be merely illustrative. For example, a well known variation to the type of conductors shown is to have two separate and electrically isolated electrodes formed on one layer of the switch with a shorting bar formed on the other layer. The first and second conductors includes any of these various forms.

The first and second conductors are separated by the universal spacer means which comprises a uniform pattern of individual spacer areas 26. These areas are shown in FIGS. 2 and 3 as squares which may be approximately 25–50 mil squares, each 100 mils apart. The spacer areas 26 are applied in liquid form by spraying, silk-screening or painting. The liquid is, of course, allowed to dry or is cured before the switch is assembled. In the embodiment of FIG. 2 the spacer squares 26 are applied to both the membrane 12 and the substrate 16. Also, the spacer squares 26 are shown as being in alignment on the membrane and substrate. Neither of these conditions is necessary. Where the spacer squares are applied to both surfaces it is not required that the squares be aligned with each other although that is the preferred arrangement. Nor is it required that the spacer squares be applied to both the membrane and substrate. In some instances it will be sufficient to place the universal spacer means only on one surface.

The two halves of the switch are held together in sandwich fashion by adhesive material which is applied to the spacer areas. The adhesive is shown at 28 in FIGS. 2 and 3. The adhesive may be applied to all the spacer areas 26 or to just some of them. In the embodiment shown the adhesive is applied to each spacer area on both the membrane and substrate. In this connection, it may be advantageous to use an adhesive which adheres only to itself. This simplifies handling of the switch parts prior to final assembly. Alternately, the adhesive could be ultra-violet curable resin. Or no adhesive would be used if suitable mechanical mounting is available.

Figure 4:
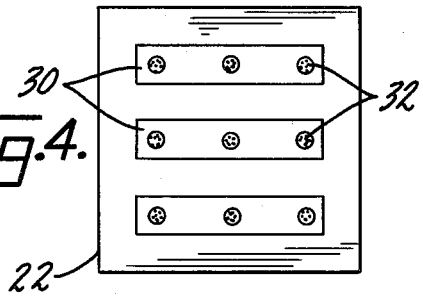
FIG. 4 is a top plan view, similar to FIG. 3, but on a smaller scale and showing a modified form of spacer means.
Figure 5:
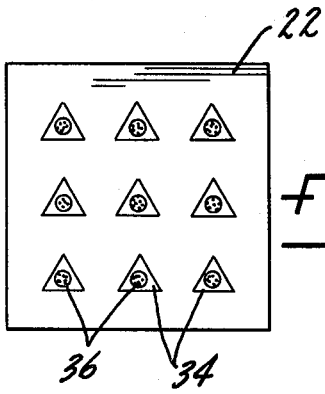
FIG. 5 is a top plan view, similar to FIG. 4, but illustrating a further form of spacer means.

FIGS. 4 and 5 show alternate configurations for the universal spacer means. In FIG. 4 the spacer means 30 are in the form of bars or rectangles. The adhesive spots 32 are applied to the bars for the purpose described above. In FIG. 5 the spacer areas 34 are in the form of a uniform pattern of triangles with adhesive spots 36. FIG. 6 shows a pattern of spacer stripes on the order of 100 mils wide. The vertical stripes 38 are on the substrate and the horizontal stripes 40 are on the membrane, or vice versa. Adhesive is applied selectively at the junction points. This can also be used as a cross hatch pattern where both horizontal and vertical stripes are on either the membrane or substrate or both. This would be advantageous where a thick spacer means is needed. Another spacer pattern is shown in FIG. 7. The vertical rectangles 42 are on the membrane and the horizontal rectangles 44 are on the substrate. A typical rectangle size might be 25 mils by 50 mils. This pattern allows for some misadjustment of membrane to substrate without causing any problems. Also, it uses less material than the full stripe pattern on FIG. 6. The particular form of the spacer areas is not critical so long as the size and spacing of the spacer areas does not completely cover the conductors so as to totally prevent contact between them.

FIGS. 8 and 9 show a portion of a switch at two different stages of its manufacture. In FIG. 8 an alternate form of second conductor 46 has been formed on a substrate 16. The conductor 46 includes a set of interdigitated fingers 48 to which spaced lead lines 50 and 52 may be connected. The lead lines may be connected to the auxiliary electronics in a suitable manner. The first conductor is not shown but it will be understood that the membrane would carry a shorting bar which, when depressed, would bridge the gap between two of the fingers 48 to close the switch. Once the second conductor 46 is completed the universal spacing means may be applied to the substrate. As noted above, this may be done by painting, silk-screening or spraying the pattern of spacer areas onto the substrate. This is shown in FIG. 9 as having been completed. The spacer areas 54 are applied without regard to the location of the fingers 48 or the leads 50 and 52. Thus no matter what pattern of conductors is used the same pattern of spacer areas can be used.

The structure of the spacer means provides for automatic pressure regulation in the space between the membrane and substrate. The individual nature of the spacer areas allows pressure changes due to actuation of the switch to be dissipated throughout the entire space between the membrane and substrate. Since the volume change due to switch actuation is small compared to the total volume between the membrane and substrate, pressure imbalance is not a problem.

FIG. 10 shows yet another embodiment of the invention. The conductor 56 includes a plurality of leads 58 connected to contact pads or switch sites 60. The spacer means is a two-dimensional lattice of spacer areas or dots 62. The spacer lattice is made up of a pattern of unit cells, such as the one shown in FIG. 11. Each unit cell is bounded by an imaginary box whose corners are at the center of four adjacent spacer dots 62. The dotted line shows the unit cell boundary. FIG. 11 illustrates that each unit cell includes a portion of four spacer dots and has an opening 64 defined between those dots. Since the spacer means comprises many unit cells, the spacer includes many openings. As will be apparent from the above discussion, the openings are numerous enough compared to the number of switch sites and are sized such that every switch site will be in register with at least parts of one or more openings. This allows electrical contact to be made in response to actuating pressure on the membrane. By way of example only, the spacer lattice shown may have 120 mil diameter dots on 240 mil centers with the pads 60 being about 240 mils in diameter. It will be understood that absolute uniformity of the spacer lattice is not required.

The switch actuating force will be variable according to the particular lattice spacing and thickness, as well as the size of the spacer areas or dots. Thus, the present invention provides flexibility in the design of switches requiring more or less actuating force.

Whereas the preferred form of the invention has been shown and described herein, it should be realized that there may be many modifications, substitutions and alterations thereto.

The embodiments of the invention in which an exclusive property or privilege is claimed are defined as follows:

1. In a membrane switch, a flexible membrane, a substrate, a plurality of first conductors formed on the membrane, a plurality of second conductors formed on the substrate and spacer means disposed between the first and second conductors, the improvement characterized in that said spacer means is a universal spacer means which can be used with any arrangement of first and second conductors, said universal spacer means comprising a pattern of individual, non-conductive spacer areas on either the membrane or substrate, said spacer areas having a size, spacing and thickness that allows contact between aligned first and second conductors in response to pressure upon the exterior of said membrane while otherwise maintaining said conductors in non-contacting spaced relation.

2. The structure of claim 1 wherein the spacer areas are further on both the membrane and substrate.

3. The structure of claim 1 wherein the first conductor is a shorting bar and the second conductor includes a pair of spaced electrodes having interdigitated fingers connected to separate lead lines.

4. In a membrane switch of the type having a flexible membrane with a plurality of first conductors formed thereon, a substrate with a plurality of second conductors formed thereon, and non-conductive spacer means disposed between the first and second conductors, a method of forming said non-conductive spacer means so as to form a universal spacer means which can be used with any arrangement of first and second conductors, said method including the step of applying to either the membrane or substrate without regard to where the conductors lie, a pattern of individual spacer areas applied in liquid form which is then dried, said spacer areas having a size, spacing and thickness that allows contact between aligned first and second conductors in response to pressure upon the exterior of said membrane while otherwise maintaining said conductors in non-contacting spaced relation.

5. The method of claim 4 further including the step of further applying spacer areas to both the substrate and membrane.

6. The method of claim 4 further characterized in that the first conductor is a shorting bar and the second conductor includes a pair of spaced electrodes having interdigitated fingers and individual lead lines.

7. A method of preparing a membrane switch keyboard of the type having a flexible membrane with a plurality of first conductors formed thereon, a substrate with a plurality of second conductors formed thereon and non-conductive spacing means disposed between the first and second conductors, the method comprising the steps of:

(1) applying the first and second conductors to the membrane and substrate;

(2) applying to either the membrane or substrate, a pattern of individual spacer areas without regard to where the conductors lie, said areas being applied in liquid form which is then dried;

(3) applying adhesive material to the spacer areas; and (4) placing the membrane on the substrate to complete the keyboard, said spacer areas having a size, spacing and thickness that allows contact between aligned first and second conductors in response to pressure upon the exterior of said membrane while otherwise maintaining said conductors in non-contacting spaced relation.

8. The method of claim 7 further including the step of applying the spacer areas to both the substrate and membrane.

9. The method of claim 7 further including the step of applying adhesive to all the spacer areas.

10. The method of claim 7 further characterized in that the first conductor is a shorting bar and the second conductor includes a pair of spaced electrodes.

11. The method of claim 7 further characterized in that the first and second conductors are applied in liquid form.

12. The method of claim 7 further characterized in that spacer areas are silk-screened onto the membrane or substrate.

13. In a membrane switch, a flexible membrane, a substrate, a set of first conductors on the membrane including a plurality of switch sites, a set of second conductors on the substrate including a plurality of switch sites in facing relation with the switch sites of the first conductors, and a universal spacer means disposed between the first and second conductors and normally holding said conductors in spaced, non-contacting relation, the spacer means having a plurality of openings through which the first conductors may move into contact with the second conductors in response to pressure on the exterior of the membrane, none of the openings being necessarily associated with any particular switch site or conductor.

14. In a membrane switch, a flexible membrane, a substrate, a set of first conductors on the membrane including a plurality of switch sites, a set of second conductors on the substrate including a plurality of switch sites in facing relation with the switch sites of the first conductors, and a universal spacer means disposed between the first and second conductors and normally holding said conductors in spaced, non-contacting relation, said spacer means comprising a pattern of non-conductive spacer areas, none of which is necessarily associated with any particular switch site or conductor.

15. In a membrane switch, a flexible membrane, a substrate, a set of first conductors on the membrane including a plurality of switch sites, a set of second conductors on the substrate including a plurality of switch sites in facing relation with the switch sites of the first conductors, and a universal spacer means which normally maintains the first and second conductors in spaced, non-contacting relation while permitting pressure-responsive contact between aligned switch sites which can be anywhere on the membrane and substrate.

* * * * *